US009281099B2

(12) United States Patent
Terasaka

(10) Patent No.: US 9,281,099 B2
(45) Date of Patent: Mar. 8, 2016

(54) ELECTRIC WIRE HOLDING STRUCTURE AND ELECTRIC WIRE HOLDING METHOD

(71) Applicant: YAZAKI CORPORATION, Tokyo (JP)

(72) Inventor: Yutaka Terasaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 226 days.

(21) Appl. No.: 13/869,715

(22) Filed: Apr. 24, 2013

(65) Prior Publication Data

US 2013/0233591 A1 Sep. 12, 2013

Related U.S. Application Data

(63) Continuation of application No. PCT/JP2011/075647, filed on Nov. 1, 2011.

(30) Foreign Application Priority Data

Nov. 1, 2010 (JP) ..... 2010-244977

(51) Int. Cl.

| | |
|---|---|
| ***H01B 7/00*** | (2006.01) |
| ***H01R 4/02*** | (2006.01) |
| ***H01R 43/02*** | (2006.01) |
| ***H01B 13/00*** | (2006.01) |

(52) U.S. Cl.

CPC ..... *H01B 7/0009* (2013.01); *H01B 13/0023* (2013.01); *H01R 4/021* (2013.01); *H01R 4/029* (2013.01); *H01R 43/0207* (2013.01); *Y10T 29/49201* (2015.01)

(58) Field of Classification Search

USPC ..... 174/117 R

See application file for complete search history.

(56) References Cited

U.S. PATENT DOCUMENTS

| | | | | |
|---|---|---|---|---|
| 587,764 | A * | 8/1897 | Short | 174/129 R |
| 3,469,020 | A | 9/1969 | Broom et al. | |
| 6,609,648 | B2 * | 8/2003 | Kondo | B23K 20/10 228/1.1 |

(Continued)

FOREIGN PATENT DOCUMENTS

| | | |
|---|---|---|
| CN | 201142248 Y | 10/2008 |
| EP | 2 192 601 A1 | 6/2010 |

(Continued)

OTHER PUBLICATIONS

Japanese Office Action for the related Japanese Patent Application No. 2010-244977 dated Sep. 9, 2014.

(Continued)

*Primary Examiner* — Timothy Thompson
*Assistant Examiner* — Krystal Robinson
(74) *Attorney, Agent, or Firm* — Kenealy Vaidya LLP

(57) ABSTRACT

An electric wire holding structure includes a plurality of electric wires each including a conductive part provided with a plurality of core wires and an insulating part covering the conductive part. The conductive part includes a rectangular conductive part which is formed at an end of the conductive part to have a rectangular outer shape in a section perpendicular to an extending direction of the electric wires. The rectangular conductive parts of the respective electric wires are bonded together by welding with ultrasonic vibration. The rectangular conductive parts of a plurality of the electric wires are piled in a brick laying manner to be bonded by welding.

11 Claims, 6 Drawing Sheets

(56) References Cited

U.S. PATENT DOCUMENTS

| | | | | |
|---|---|---|---|---|
| 2005/0168096 | A1* | 8/2005 | Joho | 310/213 |
| 2006/0180339 | A1* | 8/2006 | Huffman | H01B 7/0018 174/117 FF |
| 2010/0096185 | A1 | 4/2010 | Otsuka et al. | |
| 2010/0259201 | A1 | 10/2010 | Kawano et al. | |

FOREIGN PATENT DOCUMENTS

| | | | | |
|---|---|---|---|---|
| JP | 2005-322544 | A | | 11/2005 |
| JP | 2005322544 | A | * | 11/2005 |
| JP | 2007-134307 | A | | 5/2007 |
| JP | 2007-149421 | A | | 6/2007 |
| JP | 2007149421 | A | * | 6/2007 |
| JP | 2007-185706 | A | | 7/2007 |
| JP | 2007185706 | A | * | 7/2007 |
| JP | 2010-218796 | A | | 9/2010 |
| JP | 2010-244977 | A | | 10/2010 |

OTHER PUBLICATIONS

Decision on Grant from Russian Patent Office for the related Russian Patent Application No. 2013125490 dated Jul. 7, 2014.

Chinese Office Action for the related Chinese Patent Application No. 201180052878.4 dated Dec. 3, 2014.

Chinese Office Action for the related Chinese Patent Application No. 201180052878.4 dated Aug. 13, 2015.

International Search Report and Written Opinion of the International Search Report for PCT/JP2011/075647 dated Feb. 9, 2012.

* cited by examiner

ELECTRIC WIRE HOLDING STRUCTURE AND ELECTRIC WIRE HOLDING METHOD

CROSS REFERENCE TO RELATED APPLICATION

This application is a continuation of PCT application No. PCT/JP2011/075647, which was filed on Nov. 1, 2011 based on Japanese Patent Applications No. 2010-244977 filed on Nov. 1, 2010, the contents of which are incorporated herein by reference.

BACKGROUND OF THE INVENTION

1. Technical Field

The present invention relates to an electric wire holding structure and an electric wire holding method for holding a plurality of electric wires.

2. Background Art

Conventionally, there has been an electric wire holding structure including a plurality of electric wires each of which is provided, at an end thereof, with a conductive part having a rectangular outer shape in a section perpendicular to an extending direction of the electric wires, wherein a plurality of the electric wires are bonded together by welding the rectangular conductive parts of the respective electric wires with ultrasonic vibration. More specifically, this electric wire holding structure is so constructed that the conductive parts which are formed in a rectangular shape having substantially the same size are aligned in both vertical and lateral directions, to be bonded together by welding.

By the way, in case where a vibrating direction of ultrasonic waves is parallel to the faces to be bonded, the bonding faces which are parallel to the vibrating direction vibrate adjacent faces relative to each other, thereby to transmit the vibration. Therefore, the ultrasonic vibration is likely to be damped under influence of the bonding faces which are parallel to the vibrating direction. For this reason, as goes apart from an ultrasonic horn which is an ultrasonic vibration generating source, the ultrasonic vibration is likely to be damped.

On the other hand, in case where the vibrating direction of the ultrasonic waves is perpendicular to the bonding faces, the ultrasonic vibration is unlikely to be damped even at a position separated from the ultrasonic horn, because the bonding faces are vibrated in the vibrating direction to transmit the vibration.

Accordingly, although in a region where the conductive parts are bonded on a plane which is perpendicular to the vibrating direction of the ultrasonic waves, a bonding strength is unlikely to be deteriorated even at a position separated from the ultrasonic horn, in a region where the conductive parts are bonded on a plane which is parallel to the vibrating direction of the ultrasonic waves, the bonding strength is likely to be deteriorated at the position separated from the ultrasonic horn.

Under the circumstances, there has been employed such an electric wire holding method that the ultrasonic vibration is applied again to a plurality of electric wires which have been aligned in both vertical and lateral directions and bonded together by welding, from a position rotated by 90 degree, thereby to prevent deterioration of the bonding strength of the electric wires in both the vertical and lateral directions.

Moreover, an electric wire holding method for preventing deterioration of the bonding strength of a plurality of electric wires is disclosed in JP-A-2007-185706.

In the electric wire holding method disclosed in JP-A-2007-185706, in a state where core wires of two of a plurality of electric wires are clamped between a pair of dies, ultrasonic vibration is applied to one of the dies thereby to bond the core wires of the two electric wires to each other. Thereafter, the core wires of the other electric wires are superposed on a first bonded core wire bundle composed of the bonded core wires of the two electric wires, one by one. Every time the core wires are superposed one by one, in a state where the first bonded core wire bundle and the core wires of the other electric wires which are superposed on the first bonded core wire bundle are clamped between a pair of the dies, the ultrasonic vibration is applied to one of the dies, thereby to bond the core wires of the other electric wires to the first bonded core wire bundle, one by one.

SUMMARY OF THE INVENTION

However, in the above described electric wire holding method, welding treatments must be repeatedly conducted, and there has been such a problem that complicated works are required.

This invention has been made in view of the above described circumstances, and it is an object of the invention to provide an electric wire holding structure and an electric wire holding method in which deterioration of bonding strength between a plurality of electric wires can be prevented, without requiring complicated welding and bonding works.

In order to solve the above described problems and to attain the object, there is disclosed, according to the invention, an electric wire holding structure including a plurality of electric wires each including a conductive part provided with a plurality of core wires and an insulating part covering the conductive part, the conductive part comprising a rectangular conductive part which is formed at an end thereof so as to have a rectangular outer shape in a section perpendicular to an extending direction of the electric wires, wherein the rectangular conductive parts of the respective electric wires are bonded together by welding with ultrasonic vibration, characterized in that the rectangular conductive parts of a plurality of the electric wires are piled in a brick laying manner to be bonded together by welding.

Moreover, the electric wire holding structure according to the invention is characterized, in the aforesaid invention, in that the rectangular conductive parts have the same thickness in a piling direction.

Further, the electric wire holding structure according to the invention is characterized, in the aforesaid invention, in that the rectangular conductive parts have a rectangular outer shape in the section, and a direction of a shorter side of the section is set to be the piling direction.

In order to solve the above described problems and to attain the object, there is disclosed, according to the invention, an electric wire holding method in which rectangular conductive parts are formed in respective ends of a plurality of electric wires, as conductive parts having a rectangular outer shape in a section perpendicular to an extending direction of the electric wires, and the rectangular conductive parts of a plurality of the electric wires are bonded together by welding with ultrasonic vibration, characterized by including a piling step for piling the rectangular conductive parts of a plurality of the electric wires in a brick laying manner, and a welding and bonding step for applying the ultrasonic vibration to the rectangular conductive parts which have been piled in the brick laying manner thereby to bond the rectangular conductive parts together by welding.

Moreover, the electric wire holding method according to the invention is characterized, in the aforesaid invention, in that each of the rectangular conductive parts has a rectangular outer shape in the section, and in the piling step, a direction of a shorter side of the section of the rectangular conductive part is set to be a piling direction.

Further, the electric wire holding method according to the invention is characterized, in the aforesaid invention, in that in. the bonding and welding step, the ultrasonic vibration which is parallel to the piling direction of the rectangular conductive parts is applied.

The electric wire holding structure according to the invention includes a plurality of electric wires each having a rectangular conductive part which is formed at an end thereof, as a conductive part having a rectangular outer shape in a section perpendicular to an extending direction of the electric wires, wherein the rectangular conductive parts of the respective electric wires are bonded together by welding with ultrasonic vibration, and the rectangular conductive parts of a plurality of the electric wires are piled in a brick laying manner to be bonded together by welding. Therefore, an upper face or a bottom face of the rectangular conductive part which forms a bonding part in a vertical direction is arranged across a bonding part in a lateral direction. In case where the ultrasonic vibration in the vibrating direction which is parallel to side faces of the rectangular conductive part is applied, bonding strength of the bonding part in the lateral direction can be reinforced by the bonding part in the vertical direction where the bonding strength is unlikely to be deteriorated. As the results, it is possible to prevent deterioration of the bonding strength of a plurality of the electric wires, without making the welding and bonding work complicated.

In the electric wire holding method according to the invention, the rectangular conductive parts are formed in the respective ends of a plurality of the electric wires, as the conductive parts having a rectangular outer shape in the section perpendicular to the extending direction of the electric wires, and the rectangular conductive parts of a plurality of the electric wires are bonded together by welding with the ultrasonic vibration, and the electric wire holding method includes the piling step for piling the rectangular conductive parts of a plurality of the electric wires in the brick laying manner, and the welding and bonding step for applying the ultrasonic vibration to the rectangular conductive parts which have been piled in the brick laying manner thereby to bond the rectangular conductive parts together by -welding. Therefore, an upper face or a bottom face of the rectangular conductive part which forms a bonding part in a vertical direction is arranged across a bonding part in a lateral direction. In case where the ultrasonic vibration in the vibrating direction which is parallel to side faces of the rectangular conductive part is applied, bonding strength of the bonding part in the lateral direction can be reinforced by the bonding part in the vertical direction. As the results, it is possible to prevent deterioration of the bonding strength of a plurality of the electric wires, without making the welding and bonding work complicated.

DETAILED DESCRIPTION OF THE EXEMPLARY EMBODIMENTS

Figure 1:
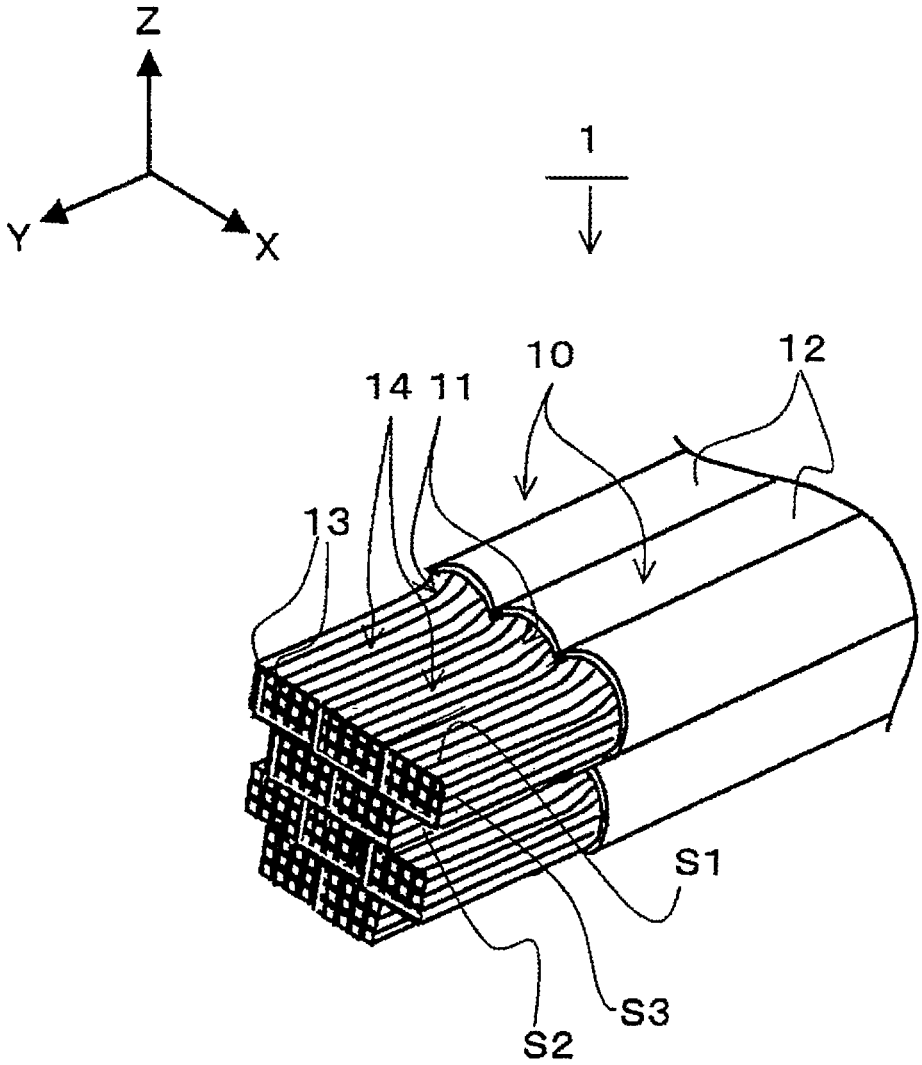
FIG. 1 is a perspective view showing an electric wire holding structure in an embodiment according to the invention.

Now, a preferred embodiment of the electric wire holding structure and the electric wire holding method according to the invention will be described in detail, referring to the drawings.

(Embodiment)

Figure 2A:
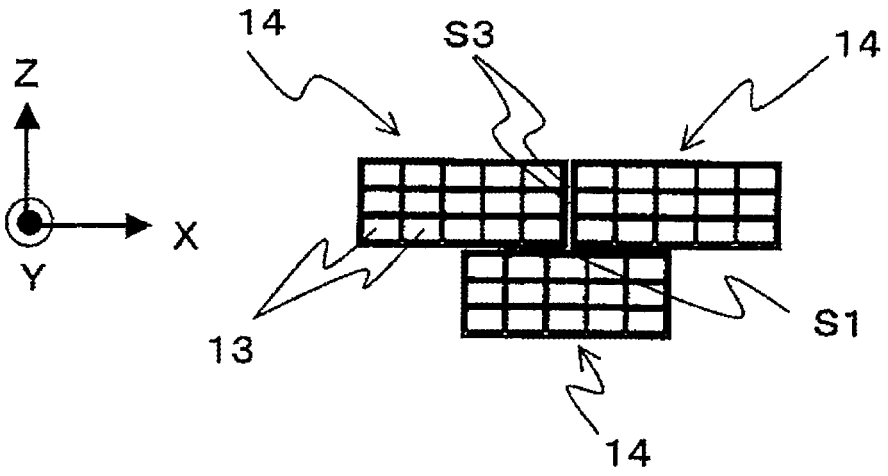
FIGS. 2A and 2B are enlarged views of an essential part of the electric wire holding structure as shown in FIG. 1.
Figure 2B:
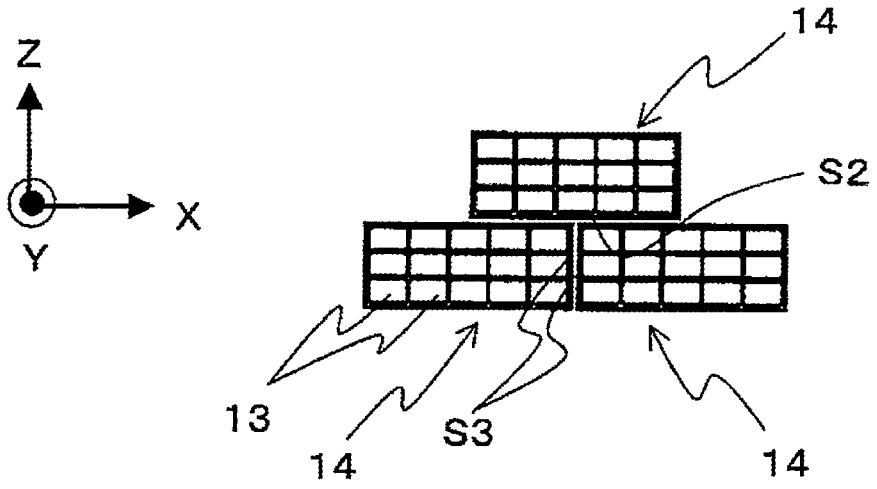

FIG. 1 is a perspective view showing an electric wire holding structure 1 in an embodiment according to the invention. FIGS. 2A and 2B are enlarged views of an essential part of the electric wire holding structure 1 as shown in FIG. 1. The electric wire holding structure 1 includes ten pieces of electric wires 10 which are superposed on one another and bonded together by welding, as shown in FIG. 1. Each of the electric wires 10 has a conductive part 11, and an insulating part 12 which covers the conductive part 11 for insulation and protection. It is to be noted that an arrow mark Y in the drawings represents an extending direction of the electric wire 10. Moreover, an arrow mark X represents a direction perpendicular to the arrow mark Y. Further, an arrow mark Z represents a direction perpendicular to a plane formed of the directions of the arrow marks X and Y.

The conductive part 11 is a bundle composed of a plurality of core wires 13 which are formed of conductors such as aluminum. The conductive part 11 has a rectangular conductive part 14 at its distal end. The rectangular conductive part 14 is a part of the electric wire 10 where the insulating part 12 at a distal end of the electric wire 10 is peeled off to form a rectangular outer shape in a section perpendicular to the extending direction of the electric wire 10. The rectangular conductive part 14 is formed, for example, by compressing work.

In the electric wire holding structure 1, the rectangular conductive parts 14 in a rectangular shape of a plurality of the electric wires 10 are piled on one another in a brick laying manner, and bonded together by welding. The electric wire holding structure 1 is so constructed that a plurality of the electric wires 10 are bonded together by welding, by setting a direction of a shorter side of a section of the rectangular conductive part 14 to be a piling direction (Z direction) , and by setting an upper face S1, a bottom face S2 or side faces S3, S3 of the rectangular conductive part 14 to be bonding faces.

The brick laying manner means a manner in which a bonding part between a pair of the rectangular conductive parts 14, 14 which are bonded to each other at their side faces S3 is positioned directly above the upper face S1 of the other rectangular conductive part 14 which is arranged below these rectangular conductive parts 14, 14, as shown in FIG. 2A, or a manner in which a bonding part between a pair of the rectangular conductive parts 14, 14 which are bonded to each other at their side faces S3 is positioned directly below the bottom face S2 of the other rectangular conductive part 14 which is arranged above these rectangular conductive parts 14, 14, as shown in FIG. 2B.

The brick laying manner means the manner in which the bonding parts between the rectangular conductive parts 14 in a direction perpendicular to the piling direction (the Z direction) are staggered in the piling direction.

Then, referring to FIGS. 3A to 3D, an electric wire holding method employing the electric wire holding structure 1 in the embodiment according to the invention will be described. FIGS. 3A to 3D are views showing steps in the electric wire holding method employing the electric wire holding structure 1 in the embodiment according to the invention.

In this electric wire holding method, an ultrasonic horn 20 and an anvil 21 are used. The ultrasonic horn 20 has an ultrasonic vibrator which is not shown, and generates ultrasonic vibration by means of this ultrasonic vibrator. Moreover, the anvil 21 functions as a receiver of a brick piled body 140, when the ultrasonic vibration is applied to the brick piled body 140.

Figures 3A, 3B, 3C, 3D:
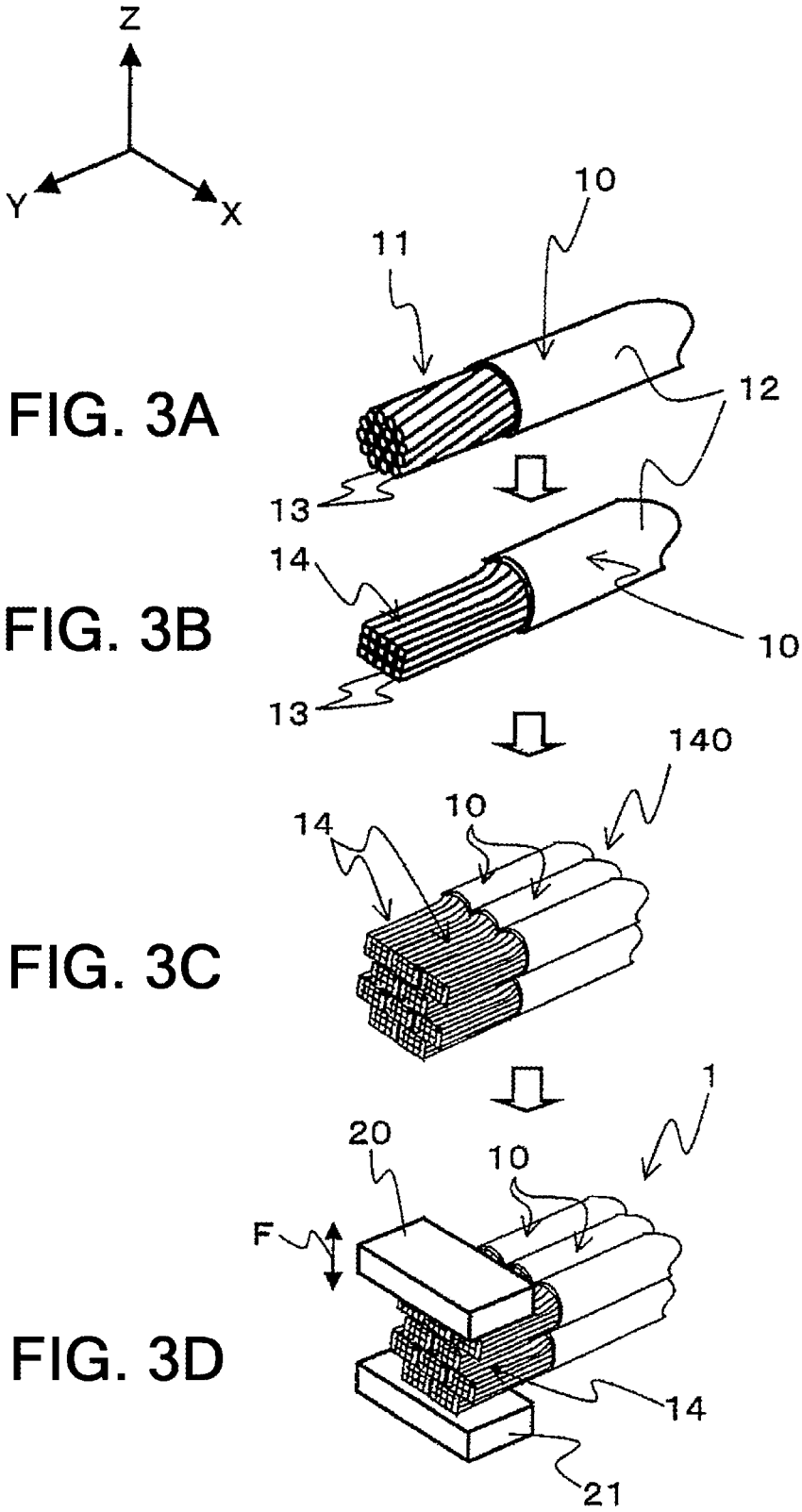
FIGS. 3A to 3D are views showing steps in an electric wire holding method employing the electric wire holding structure in the embodiment according to the invention.

As a first step, a worker peels off the insulating part 12 at the distal end of each of the electric wires 10 to expose the conductive part 11 (See FIG. 3A).

Thereafter, the worker forms the exposed conductive part 11 of the electric wire 10 into a determined shape (See FIG. 3B). More specifically, the exposed conductive part 11 at the distal end of the electric wire 10 is subjected to a compressing work so that the section of the conductive part 11 perpendicular to the extending direction of the electric wire 10 may have a rectangular outer shape. This conductive part is formed as the rectangular conductive part 14 which is provided with the bonding faces.

Thereafter, the worker piles the rectangular conductive parts 14 of the electric wires 10 in such a manner that the upper faces S1, the bottom faces S2 or the side faces S3 of the rectangular conductive parts 14 may be contacted with each other (See FIG. 3C). in this piling work in the brick laying manner, the bonding part between a pair of the rectangular conductive parts 14, 14 which are bonded to each other at their side faces S3 is positioned directly above the upper face S1 of the other rectangular conductive part 14 which is arranged below these rectangular conductive parts 14, 14, or positioned directly below the bottom face S2 of the other rectangular conductive part 14 which is arranged above these rectangular conductive parts 14, 14.

For the purpose of maintaining the piled state of the rectangular conductive parts 14 which are piled in the brick laying manner (hereinafter, referred to as "the brick piled body 140") , it is recommended that the brick piled body 140 is held by holding means.

Thereafter, the worker applies the ultrasonic vibration to the brick piled body 140, using the ultrasonic horn 20 and the anvil 21, thereby to bond a plurality of the electric wires 10 together by welding (See FIG. 3D). More specifically, the brick piled body 140 is set on the anvil 21, and the ultrasonic horn 20 is pressed against the brick piled body 140 from the above, thereby to apply the ultrasonic vibration, while the brick piled body 140 is clamped and pressed between the ultrasonic horn 20 and the anvil 21. This ultrasonic vibration is transmitted to the bonding faces S1, S2, S3, and the rectangular conductive parts 14 are overheated and welded thereby to bond the bonding faces S1, S2, S3 together. A vibrating direction of the ultrasonic waves generated from the ultrasonic horn 20 is made parallel to the side faces S3 of the rectangular conductive parts 14, as shown by an arrow mark F in FIG. 3D). In short, the vibrating direction F is the same direction as the piling direction (the Z direction).

Figure 4:
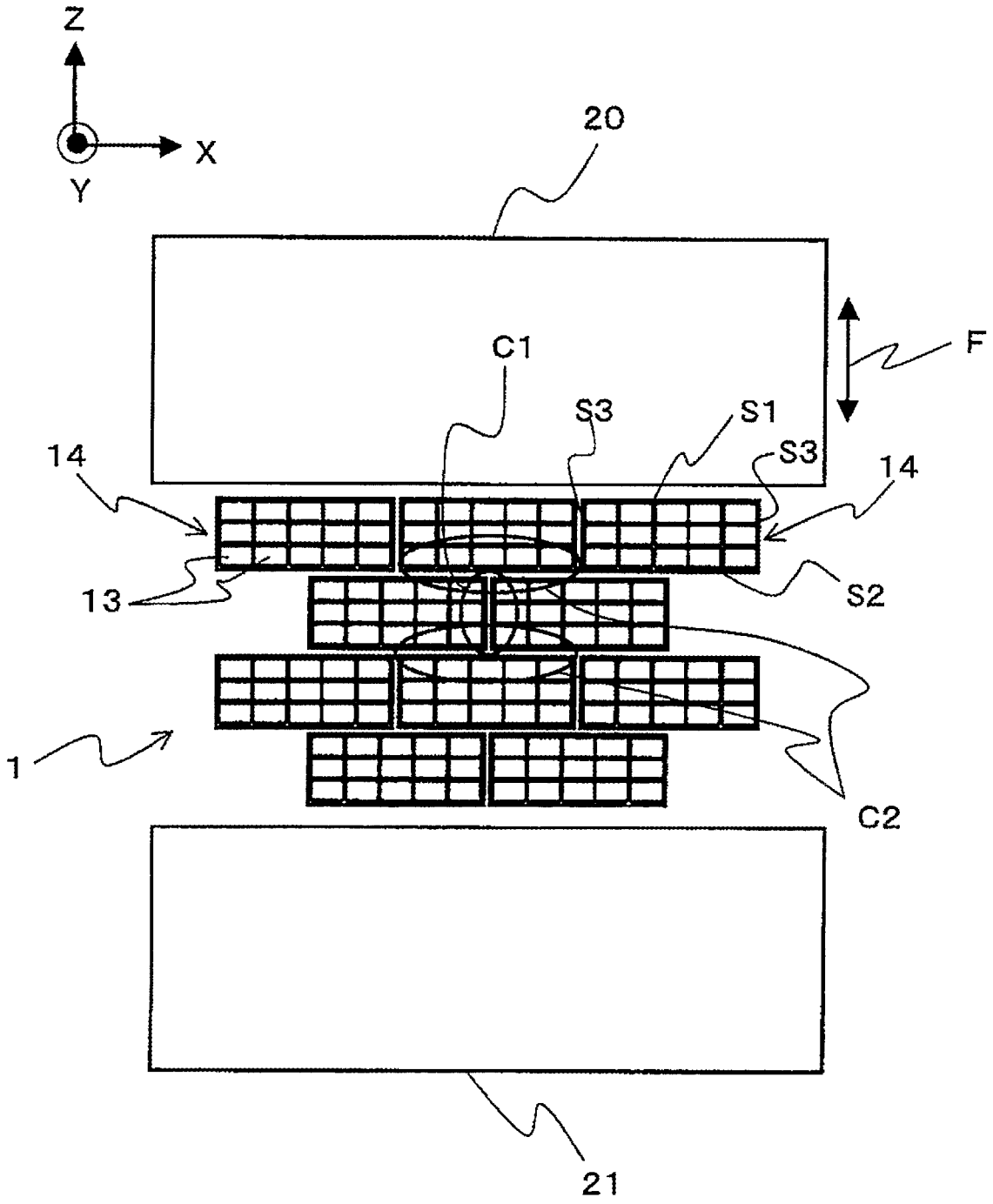
FIG. 4 is a view for explaining a state where the electric wires are bonded by welding in the electric wire holding structure in the embodiment according to the invention.

Now, referring to FIG. 4, a state where the rectangular conductive parts are bonded by welding in the electric wire holding structure 1 will be described. FIG. 4 is a view for explaining the state where the rectangular conductive parts are bonded by welding in the electric wire holding structure 1 as shown in FIG. 1.

As shown in FIG. 4, in the electric wire holding structure 1, the side faces S3, S3 of a pair of the rectangular conductive parts 14 which form a bonding part C1 in the lateral direction (the X direction) of the rectangular conductive parts 14 which are piled in the brick laying manner are parallel to the vibrating direction F. For this reason, the bonding strength of the bonding part C1 is likely to be deteriorated. Under the circumstances, the electric wire holding structure 1 is so constructed that the upper face S1 or the bottom face S2 of the rectangular conductive part 14 which forms a bonding part C2 in a vertical direction (the Z direction) is arranged across the boding part C1, and thus, the bonding part C2 in the vertical direction reinforces the bonding strength of the bonding part C1 in the lateral direction.

In the electric wire holding structure 1 in the embodiment according to the invention, a plurality of the electric wires 10 are piled in the brick laying manner, and bonded together by welding, and therefore, the upper face S1 or the bottom face S2 of the rectangular conductive part 14 which forms the bonding part C2 in the vertical direction (the Z direction) is arranged across the bonding part C1 in the lateral direction (the X direction). Accordingly, in case where the ultrasonic vibration in the vibrating direction which is parallel to the side faces S3 of the rectangular conductive part 14, the bonding strength of the bonding part C1 in the lateral direction can be reinforced by the bonding part C2 in the vertical direction where the bonding strength is unlikely to be deteriorated. As the results, it is possible to prevent deterioration of the bonding strength of a plurality of the electric wires 10, without making the welding and bonding work complicated.

Moreover, in the electric wire holding structure 1 in the embodiment of the invention, the direction of the shorter side of the section of the rectangular conductive part 14 is set to be the piling direction (the Z direction), and hence, an area of the bonding part C2 in the vertical direction can be made larger, as compared with the bonding part CI in the lateral direction. As the results, the bonding strength of the bonding part C1 can be more reliably reinforced by the bonding part C2, as compared with a case where a direction of a longer side of the section of the rectangular conductive part 14 is set to be the piling direction.

(Modification 1)

Figure 5:
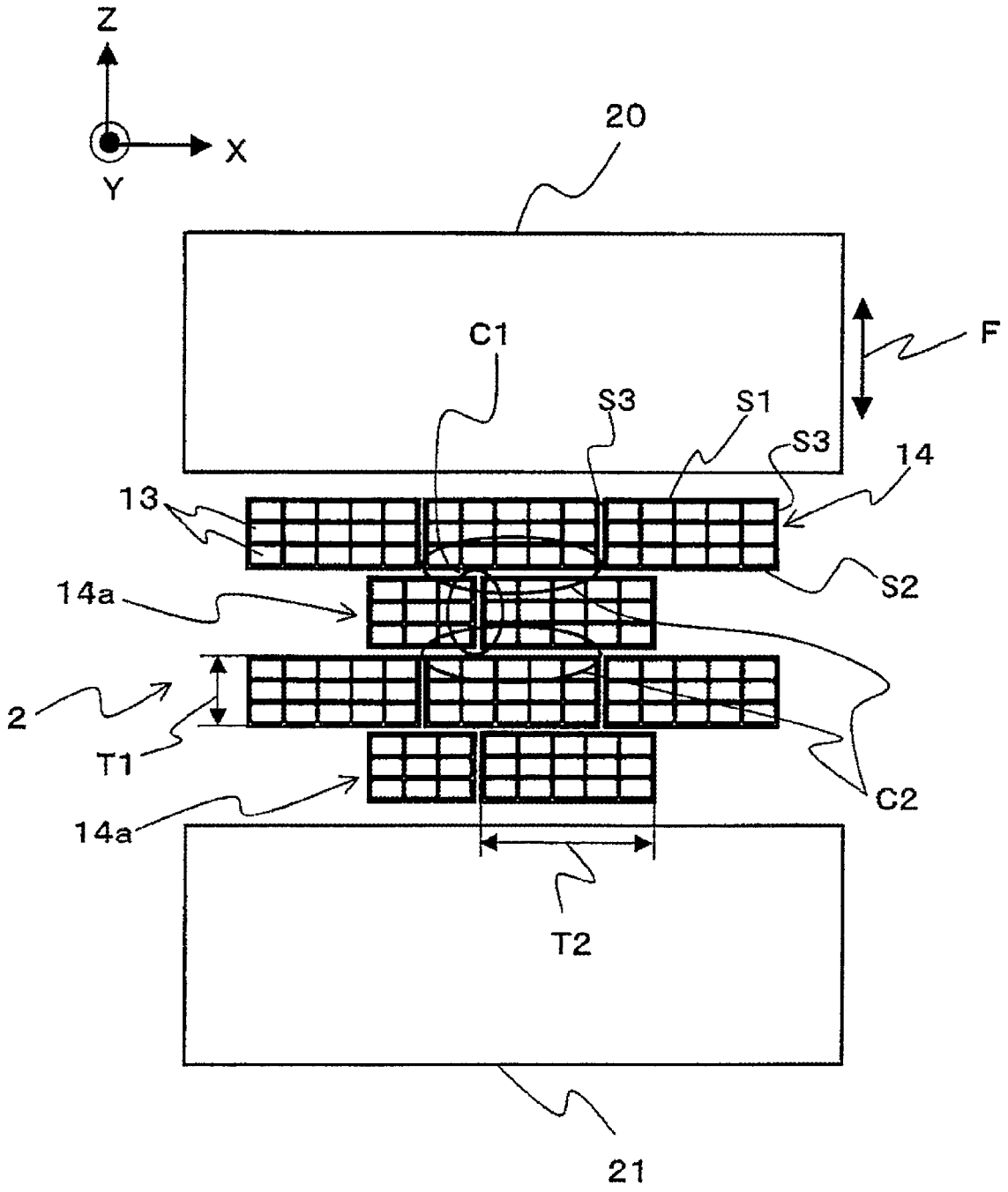
FIG. 5 is a view showing Modification 1 of the electric wire holding structure in the embodiment according to the invention.

Then, Modification 1 of the embodiment according to the invention will be described. FIG. 5 is a view showing Modification 1 of the electric wire holding structure 1 in the embodiment according to the invention. In the electric wire holding structure 1 in the embodiment according to the invention, the rectangular conductive parts 14 of a plurality of the electric wires 10 which have been compressed so as to have the same size are exemplified. However, it would be sufficient that the rectangular conductive parts have a same thickness T1 in the piling direction (the Z direction). For this reason, in an electric wire holding structure 2 in Modification 1, rectangular conductive parts 14*a* which have a different thickness T2 in a direction perpendicular to the piling direction are mixed, as shown in FIG. 5, and the rectangular conductive parts 14 and 14*a* are piled in the brick laying manner. Also in the electric wire holding structure 2 in Modification 1, the bonding part C2 in the vertical direction reinforces the bonding strength of the bonding part C1 in the lateral direction, and hence, substantially the same effects as in the embodiment according to the invention can be attained. In short, it is possible to prevent deterioration of the bonding strength of a plurality of the electric wires 10, without making the welding and bonding work complicated.

(Modification 2)

Figure 6:
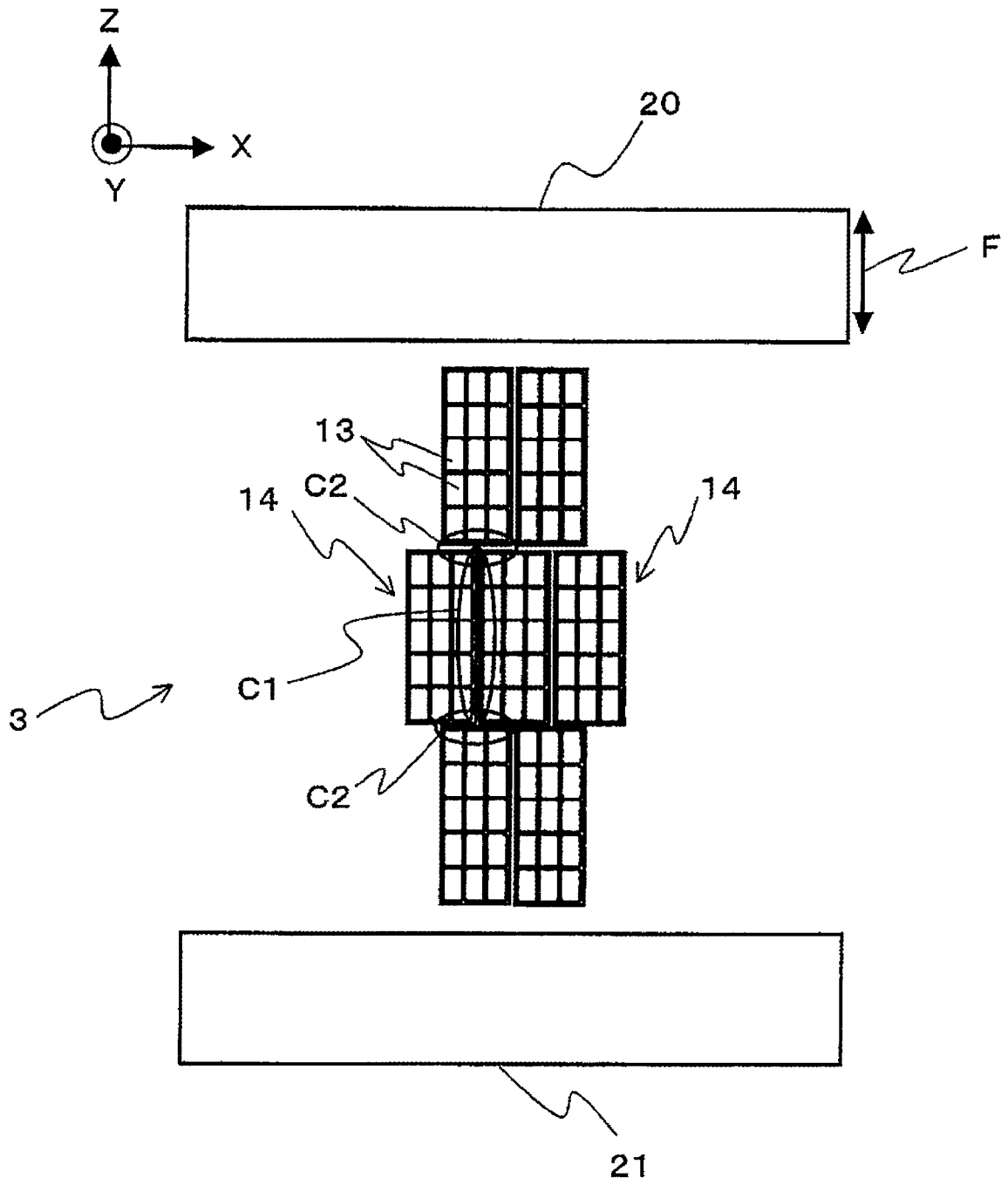
FIG. 6 is a view showing Modification 2 of the electric wire holding structure in the embodiment according to the invention.

Then, Modification 2 of the embodiment according to the invention will be described. FIG. 6 is a view showing Modification 2 of the electric wire holding structure 1 in the embodiment according to the invention. In the embodiment according to the invention, a case where the direction of the shorter side of the section of the rectangular conductive part 14 is the piling direction (the Z direction) is exemplified. However, in an electric wire holding structure 3 in Modification 2, the direction of the longer side of the section of the rectangular conductive part 14 is set to be the piling direction, as shown in FIG. 6. Also in this electric wire holding structure 3 in Modification 2, the bonding part C2 in the vertical direction reinforces the bonding strength of the bonding part C1 in the lateral direction, and hence, substantially the same effects as in the embodiment according to the invention can be attained. In short, it is possible to prevent deterioration of the bonding strength of a plurality of the electric wires 10, without making the welding and bonding work complicated.

Although in the embodiment according to the invention, the structure where ten pieces of the electric wires 10 are piled to be welded is exemplified, the number of the electric wires is not limited to this. Specifically, it would be sufficient that the rectangular conductive parts 14 of a plurality of the electric wires 10 are piled in the brick laying manner and bonded together by welding. For example, two of the three electric wires 10 may be bonded at the side faces S3, and the bottom face S2 of the remaining one electric wire 10 may be positioned directly above the bonding part between the side faces S3. Alternatively, the upper face S1 of the remaining one electric wire 10 may be positioned directly below the bonding part between the side faces S3. in short, it would be sufficient that the number of the electric wires 10 is at least three.

Moreover, although in the embodiment according to the invention, the rectangular conductive part 14 having the rectangular outer shape in the section perpendicular to the extending direction of the electric wires 10 is exemplified, the outer shape of the section of the rectangular conductive part 14 is not limited to this. Specifically, it would be sufficient that the section of the rectangular conductive part 14 perpendicular to the extending direction of the electric wires 10 has a rectangular outer shape. For example, the rectangular conductive part 14 may have a square outer shape.

It is to be noted that the invention is not absolutely restricted by the above described embodiment.

According to the invention, it is possible to provide an electric wire holding structure and an electric wire holding method in which deterioration of bonding strength between a plurality of electric wires can be prevented, without requiring complicated welding and bonding works.

REFERENCE SIGNS LIST

1, 2, 3 Electric wire holding structure
10 Electric wire
11 Conductive part
12 Insulating part
13 Core wire
14 Rectangular conductive part
20 Ultrasonic horn
21 Anvil
140 Brick piled body
S1, S2, S3 Faces
F Vibrating direction

What is claimed is:

1. An electric wire holding structure comprising:

a plurality of electric wires each including a conductive part provided with a plurality of core wires and an insulating part covering the conductive part, wherein the conductive part includes a rectangular conductive part which is formed at an end of the conductive part to have a rectangular outer shape in a section perpendicular to an extending direction of the electric wires and wherein each of the rectangular conductive parts includes the plurality of core wires, and each of the rectangular conductive parts includes an upper face, a bottom face, and a pair of side faces connecting the upper face to the bottom face, the rectangular conductive parts of the respective electric wires are bonded together by welding with ultrasonic vibration, and the rectangular conductive parts of a plurality of the electric wires are piled in a brick laying manner to be bonded by welding so that the rectangular conductive parts are staggered in a piling direction such that a first bonding part is formed between respective side faces of a first pair of adjacent rectangular conductive parts and a second bonding part is formed between the one of the bottom face and the upper face of a third rectangular conductive part and the other of the bottom face and the upper face of the pair of adjacent conductive parts, and the second bonding part is arranged across the first bonding part.

2. An electric wire holding structure according to claim 1, wherein the rectangular conductive parts have the same thickness in the piling direction.

3. An electric wire holding structure according to claim 1, wherein the rectangular conductive parts have a rectangular outer shape in the section, and a direction of a shorter side of the section is set to be the piling direction.

4. An electric wire holding structure according to claim 1, wherein the rectangular conductive parts have varied widths in a direction perpendicular to the piling direction.

5. An electric wire holding structure according to claim 1, wherein the rectangular conductive parts each have a rectangular cross-section shape defined by a first pair of sides that is longer than a second pair of sides, the first pair of sides being parallel to the piling direction.

6. An electric wire holding structure according to claim 1, wherein gaps disposed between rectangular conductive parts parallel to the piling direction are misaligned in adjacent rows of rectangular conductive parts.

7. An electric wire holding method in which a plurality of electric wires each including a conductive part provided with a plurality of core wires and an insulating part covering the conductive part are provided, the conductive part comprising a rectangular conductive part at an end thereof so as to have a rectangular outer shape in a section perpendicular to an extending direction of the electric wires, and the rectangular conductive parts of a plurality of the electric wires are bonded together by welding with ultrasonic vibration, the method comprising:

piling the rectangular conductive parts of a plurality of the electric wires in a brick laying manner so that the rectangular conductive parts are staggered in a piling direction to define a brick piled body, and subsequently, welding and bonding by applying the ultrasonic vibration to the rectangular conductive parts of the brick piled body thereby to bond the rectangular conductive parts together by welding, wherein each of the rectangular conductive parts includes the plurality of core wires.

8. An electric wire holding method according to claim 7, wherein each of the rectangular conductive parts has a rectangular outer shape in the section, and in the piling step, a direction of a shorter side of the section of the rectangular conductive part is set to be the piling direction.

9. An electric wire holding method according to claim 7, wherein, in the bonding and welding step, the ultrasonic vibration which is parallel to the piling direction of the rectangular conductive parts is applied.

10. An electric wire holding method according to claim 7, wherein each of the rectangular conductive parts has a rectangular cross-section shape defined by a first pair of sides that is longer than a second pair of sides, and in the piling step, the first pair of sides being parallel to the piling direction.

11. An electric wire holding method according to claim 7, wherein in the piling step, gaps disposed between rectangular conductive parts parallel to the piling direction are misaligned in adjacent rows of rectangular conductive parts.

* * * * *